US007059802B1

(12) United States Patent
Geier et al.

(10) Patent No.: US 7,059,802 B1
(45) Date of Patent: Jun. 13, 2006

(54) VIBRATORY COMPACTOR AND COMPACT EXCITER ASSEMBLY USABLE THEREWITH

(75) Inventors: Daniel Geier, Colgate, WI (US); Ronald Brinkmann, Hartford, WI (US); Jay Baudhuin, Mayville, WI (US)

(73) Assignee: Wacker Corporation, Menomonee Falls, WI (US)

( * ) Notice: Subject to any disclaimer, the term of this patent is extended or adjusted under 35 U.S.C. 154(b) by 847 days.

(21) Appl. No.: 09/713,659

(22) Filed: Nov. 15, 2000

(51) Int. Cl.
*E01C 19/28* (2006.01)

(52) U.S. Cl. ..... 404/117; 74/87

(58) Field of Classification Search ..... 404/103, 404/130, 117, 133.05, 133.1, 133.2, 102; 74/61, 87

See application file for complete search history.

(56) References Cited

U.S. PATENT DOCUMENTS

| | | | | |
|---|---|---|---|---|
| 3,561,336 A | * | 2/1971 | Century | 404/133.2 |
| 3,892,496 A | * | 7/1975 | Lebrero | 404/117 |
| 4,176,983 A | | 12/1979 | Gardner | |
| 4,211,121 A | | 7/1980 | Brown | |
| 4,353,261 A | * | 10/1982 | Salani | 74/87 |
| 4,461,122 A | | 7/1984 | Balz | |
| 4,586,847 A | * | 5/1986 | Stanton | 404/117 |
| 4,732,507 A | | 3/1988 | Artzberger | |
| 4,830,534 A | | 5/1989 | Schmeilzer et al. | |
| 5,010,778 A | | 4/1991 | Riedl | |
| 5,082,396 A | | 1/1992 | Polacek | |
| 5,618,133 A | | 4/1997 | Mitsui et al. | |
| 5,666,852 A | | 9/1997 | Musschoot | |

FOREIGN PATENT DOCUMENTS

| | | |
|---|---|---|
| FR | 1 567 198 | 5/1969 |
| FR | 2 639 376 | 5/1990 |

OTHER PUBLICATIONS

Wacker Vibratory Trench Rollers, www.bleilesupply.com, Oct. 24, 2000.

* cited by examiner

*Primary Examiner*—Heather Shackelford
*Assistant Examiner*—Sunil Singh
(74) *Attorney, Agent, or Firm*—Boyle Fredrickson Newholm Stein & Gratz S.C.

(57) ABSTRACT

A lightweight, easy to assemble, and compact exciter assembly for a compaction device such as a drum assembly of a vibratory trench roller or the like includes a fixed weight and one or more free swinging weights mounted on an exciter shaft, without using any mounting hardware, so as to hold the free swinging weights axially in position while permitting them to swing between first and second angular positions on the exciter shaft. Preferably, the fixed weight is mounted on a central portion of the exciter shaft, and two free swinging weights are mounted adjacent the ends of the fixed weight so as to be restrained from substantial sliding movement along the exciter shaft solely by the fixed weight and other operative components of the exciter assembly such as bearings and/or gears or other torque transfer elements. The reduction in length afforded by this design permits a reversible hydraulic motor to be mounted coaxially on the end of the exciter shaft without unacceptably increasing the overall length of a drum assembly, thereby further simplifying the machine's assembly and facilitating maintenance or repair of the machine.

23 Claims, 8 Drawing Sheets

VIBRATORY COMPACTOR AND COMPACT EXCITER ASSEMBLY USABLE THEREWITH

BACKGROUND OF THE INVENTION

1. Field of the Invention

The invention relates to a vibratory compactor used, e.g., to compact backfilled trenches after a pipeline is laid or to compact the floor of a trench prior to laying a pipeline and, more particularly, relates to a vibratory compactor of the above-mentioned type and having an easy to assemble, low inertia to compact exciter assembly. The invention additionally relates to an exciter assembly usable in a vibratory compactor and to a method of assembling the exciter assembly.

2. Discussion of the Related Art

Vibratory compactors are used in a variety of ground compaction and ground leveling applications. Most vibratory compactors have plates or rollers that rest on the surface to be compacted and that are excited to vibrate so as to compact and level the worked surface. A common vibratory compactor, and one to which the invention is well-suited, is a vibratory trench roller.

The typical vibratory trench roller includes a chassis supported on the surface to be compacted by one or more rotating drum assemblies. Two drum assemblies are typically provided, each of which supports a respective subframe of the chassis. The subframes are articulated to one another by a pivot connection. Each of the drum assemblies includes a stationary axle housing and a drum that is mounted on the axle housing and that is driven to rotate by a dedicated hydraulic motor. All of the hydraulic motors are supplied with pressurized hydraulic fluid from a pump powered by an internal combustion engine mounted on one of the subframes. In addition, each drum is excited to vibrate by a dedicated exciter assembly that is located within the associated axle housing and that is powered by a hydraulic motor connected to the pump. The exciter assembly typically comprises one or more eccentric masses mounted on a rotatable shaft positioned within the axle housing. Rotation of the eccentric shaft imparts vibrations to the axle housing and to the remainder of the drum assembly. The entire machine is configured to be as narrow as possible so as to permit the machine to fit within a trench whose floor is to compacted. Machine widths of under 3 feet are common. Vibratory trench rollers of this basic type are disclosed, e.g., in U.S. Pat. Nos. 4,732,507 to Artzberger and 5,082,396 to Polacek.

Many vibratory trench rollers and some other vibratory compactors require that the amplitude of the vibrations generated by the machine's exciter assembly be varied. For instance, it is often desirable to generate relatively low amplitude vibrations during machine start and stop operations to reduce the likelihood of disturbing the freshly compacted surface and to otherwise generate higher amplitude vibrations to maximize compaction. To achieve this effect, many vibratory trench rollers incorporate a so-called "dual amplitude exciter." A dual amplitude exciter typically has multiple eccentric weights mounted on its rotatable shaft. A first, relatively massive eccentric weight is fixed to the shaft so as to rotate with it. One or more additional, less massive eccentric weights are mounted on the shaft so as to be swingable on it between at least two angular positions. Each of these "free swinging" weights has a tab or other structure that limits the range of rotation relative to the fixed weight when the exciter shaft rotates in a particular direction. When the exciter shaft is driven in a first direction, each free swinging weight swings to a first angular position on the exciter shaft in which its eccentricity adds to the eccentricity of the fixed weight, generating high amplitude vibrations. Conversely, when the exciter shaft is rotated in the opposite direction, each free swinging weight swings to a second angular position on the exciter shaft in which its eccentricity detracts from the eccentricity of the fixed weight, thereby generating low amplitude vibrations. Dual amplitude exciters are disclosed, e.g., in U.S. Pat. No. 4,830,534 to Schmelzer et al. and U.S. Pat. No. 5,618,133 to Mitsui et al.

The typical dual amplitude exciter, though adequately generating both high and low amplitude vibrations, exhibits several drawbacks and disadvantages. First, it is relatively complicated and difficult to assemble. The free swinging weights are mounted on the exciter shaft using relatively complex ring retainers that positively couple the weights to the exciter shaft so as to permit them to rotate between their first and second positions on the exciter shaft while restraining them from substantial axial movement along the exciter shaft. These retainers substantially increase the overall complexity of the exciter, hindering assembly of the machine and increasing the exciter's cost. Assembly is further hindered by the need to assemble at least part of the exciter within the drum assembly rather than as a separate subassembly that can be inserted into the axle housing as a unit. The extra hardware required to mount the free swinging weights and other components of the exciter on the exciter shaft and/or to mount the exciter in the axle housing also substantially increases the weight of the exciter, thereby increasing its inertia. The relatively high inertia undesirably increases exciter startup time.

Another problem associated with traditional exciter designs is that they are too lengthy to receive a coaxial motor when they are used on a vibratory trench roller. That is, the mounting hardware for the free weights, bearings, and other components of the exciter substantially increases the overall length of the exciter beyond that which would permit it to be mounted within an axle housing of standard length. Providing a longer axle housing is not an option because the permissible length of the axle housing is restricted by the width of the overall machine, which must be narrow enough to permit the trench roller to be placed inside a trench. As a result, it has heretofore been necessary to mount the exciter drive motor non-coaxially with the exciter drive shaft and to couple to the output shaft of the exciter drive motor to the exciter drive shaft via a gear train or similar torque transfer system. This requirement significantly increases the overall weight and complexity of the machine. It also hinders access to hydraulic hoses and connections for the exciter drive motor, hindering motor repair and maintenance.

The need therefore has arisen to provide an exciter assembly for a vibratory roller or the like that is relatively lightweight and easy to assemble.

The need has also arisen to provide an exciter assembly for a vibratory trench roller or the like that is as short as possible.

The need has additionally arisen to provide a vibratory roller that has improved startup capability and that requires less exciter drive torque than traditional vibratory rollers.

SUMMARY OF THE INVENTION

In accordance with a first aspect of the invention, an exciter assembly for a vibratory roller is provided that comprises an exciter housing, an exciter shaft rotatably journaled in the exciter housing, a fixed eccentric weight rotationally fixed to the exciter shaft, and at least one free swinging eccentric weight. The free swinging weight is mounted on the exciter shaft so as to rotate with respect to the exciter shaft between 1) a first angular position in which the eccentricity of the free swinging weight adds to the eccentricity of the fixed weight and 2) a second angular position in which the eccentricity of the free swinging weight detracts from the eccentricity of the fixed weight. The free swinging weight is mounted on the exciter shaft so as to be restrained from substantial axial movement along the exciter shaft without the use of any retaining structure that is fixed to the free swinging weight. The resultant exciter assembly is compact, lightweight, and easy to assemble.

Preferably, the free swinging weight is sandwiched between a first end of the fixed weight and a first additional operative component of the exciter assembly, typically comprising one of a torque transfer element and a bearing and is restrained from substantial axial movement along the exciter shaft solely by the first end of the fixed weight and the component. A second free swinging eccentric weight may be mounted on the exciter shaft axially between a second end of the fixed weight and a second additional operative component of the exciter assembly, typically comprising the other of the torque transfer element and the bearing, in which case the second free swinging weight is restrained from substantial axial movement along the exciter shaft by the second end of the fixed weight and the another component, respectively. As is apparent from the above, mounting hardware such as retaining rings do not form operative components of an exciter assembly.

As a result of the compact nature of the exciter assembly, it is possible to drive the exciter shaft via a motor having a rotary output shaft which is coupled to the exciter shaft and which is co-axial with the exciter shaft. The motor output shaft can be splined directly to the exciter shaft.

One possible application for the inventive exciter assembly is a vibratory roller used to compact trenches or other surfaces. In this case, and in accordance with another aspect of the invention, the vibratory roller comprises a chassis, at least one drum assembly supporting the chassis on a surface to be compacted, and an exciter assembly. The drum assembly is hollow and has a length corresponding to the width of strip to be compacted. It includes an axle housing and a drum rotatably supported on the axle housing via an axle. The exciter assembly is of the type described above in conjunction with the first aspect of the invention.

In accordance with another aspect of the invention, a simple and easily implementable method of assembling an exciter assembly for a vibratory compactor comprises fixing a torque transfer element and at least two bearings to an exciter shaft, fixing an eccentric weight to the exciter shaft, mounting first and second free swinging eccentric weights on the exciter shaft adjacent respective ends of the fixed weight so as to be rotatable a limited amount relative to the exciter shaft, and restraining the first and second free swinging weights from substantial axial movement along the exciter shaft. The restraining step is advantageously performed solely by sandwiching the first and second free swinging weights between respective ends of the fixed weight and operative components of the exciter assembly, each of the operative components comprising one of a bearing and a torque transfer element.

Preferably, the step of axially restraining the first and second free swinging weights comprises sandwiching the first free swinging weight between the fixed weight and one of the bearings and sandwiching the second free swinging weight between the fixed weight and a torque transfer element that transfers torque to another, similarly constructed exciter assembly.

These and other objects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENT

1. Resume

Pursuant to the invention, a lightweight, easy to assemble, and compact exciter assembly is provided for a compaction device such as a drum assembly of a vibratory trench roller or another vibratory compactor. The exciter assembly includes a fixed weight and one or more free swinging weights mounted on an exciter shaft, without using any mounting hardware, so as to hold the free swinging weights axially in position while permitting them to swing between first and second angular positions on the exciter shaft. Preferably, the fixed weight is mounted on a central portion of the exciter shaft, and two free swinging weights are mounted adjacent the ends of the fixed weight so as to be restrained from substantial sliding movement along the exciter shaft solely by the fixed weight and other operative components of the exciter assembly such as bearings and/or gears or other torque transfer elements. The reduction in length afforded by this design permits a reversible hydraulic motor to be mounted coaxially on the end of the exciter shaft without unacceptably increasing the overall length of a drum assembly, thereby further simplifying the machine's assembly and facilitating maintenance or repair of the machine.

2. Roller Overview

The inventive exciter assembly is usable with a variety of different vibratory compactors using an exciter assembly to impart vibration to a compaction device. It is especially well suited for use in vibratory rollers having one or more rotating drums. It will now be described in conjunction with a vibratory trench roller with the understanding that it is usable in a variety of other applications as well.

Figure 1:
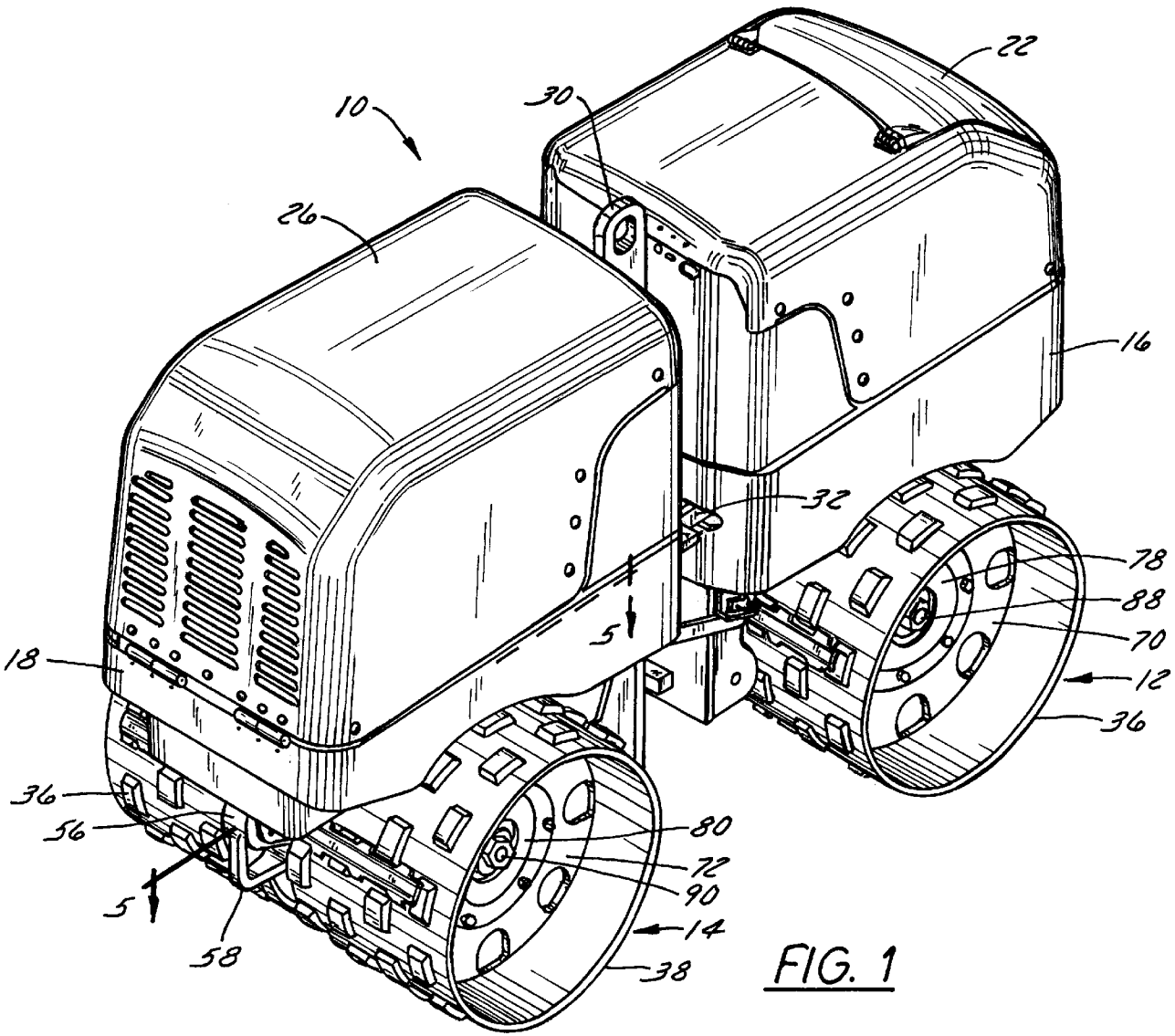
FIG. 1 is a perspective view of a vibratory trench roller constructed in accordance with a preferred embodiment of the invention.
Figure 2:
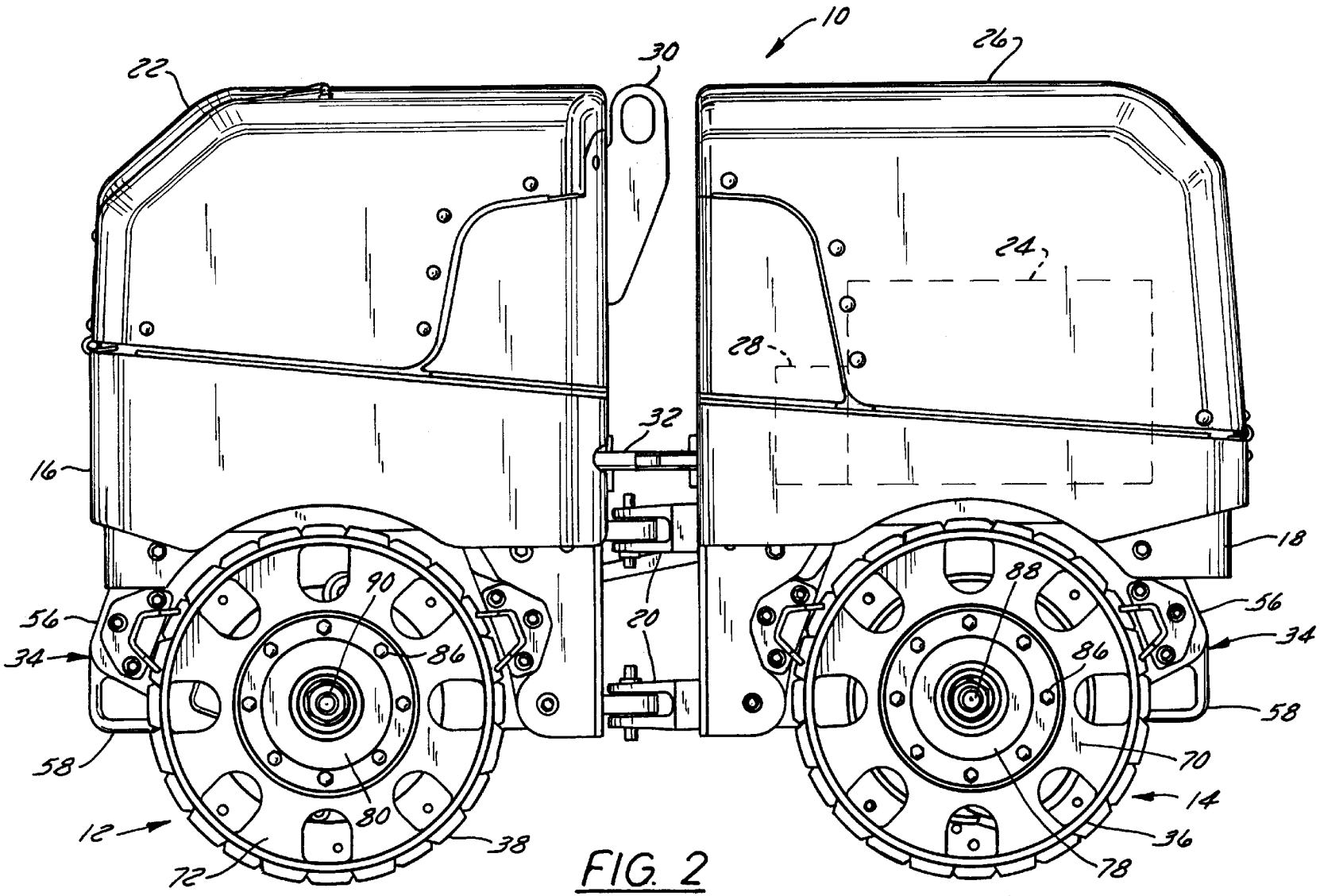
FIG. 2 is a side view of the trench roller of FIG. 1.
Figure 3:
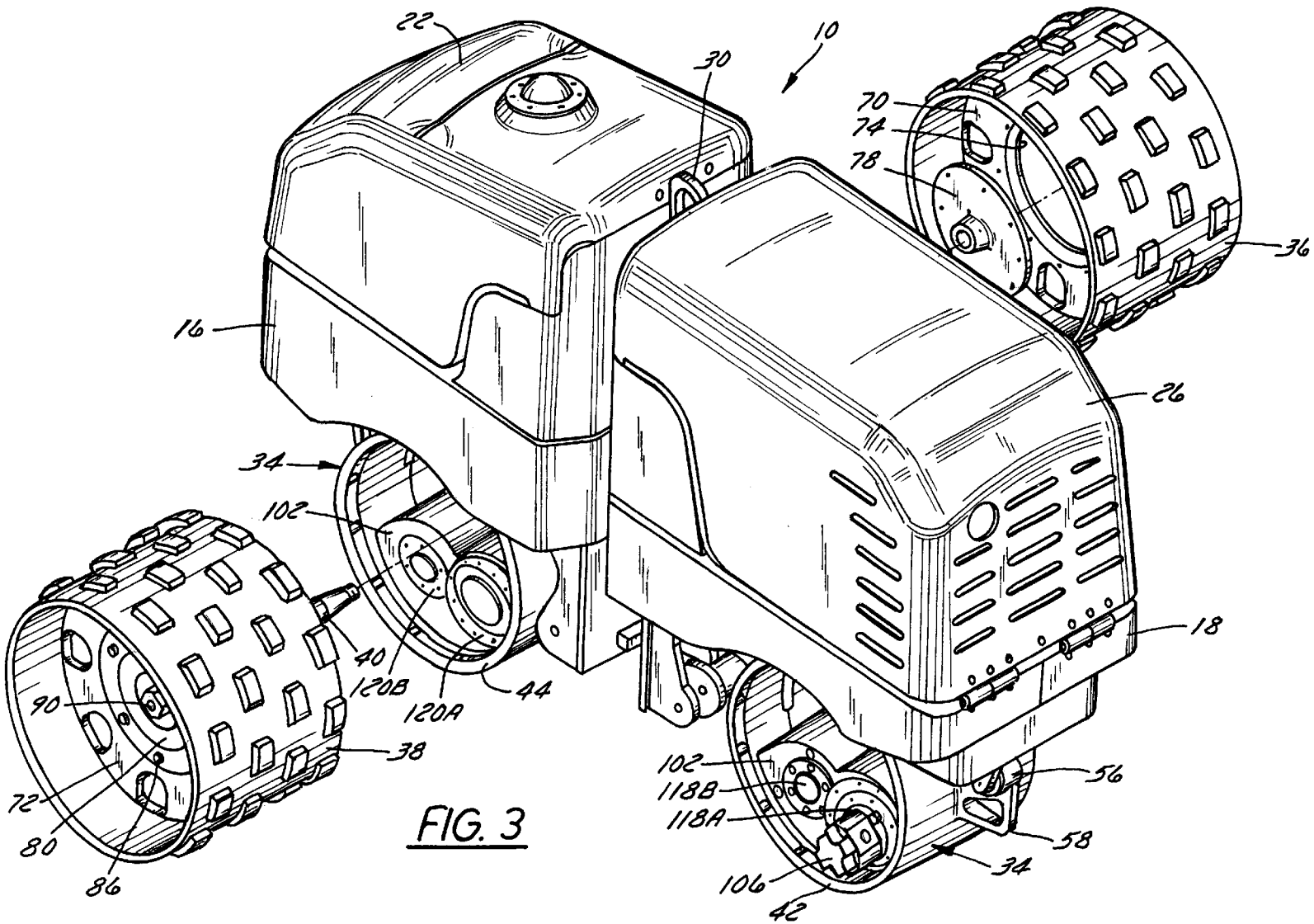
FIG. 3 is a partially exploded perspective view of the trench roller of FIGS. 1 and 2.

Referring now to FIGS. 1–3, a vibratory trench roller 10 is illustrated in accordance with a preferred embodiment of the invention. The roller 10 is a so-called walk behind trench roller comprising a self-propelled machine supported on the ground via rear and front rotating drum assemblies 12 and 14. The machine 10 comprises an articulated chassis having rear and front subframes 16 and 18 connected to one another via a pivot connection 20 (FIG. 2). The chassis is only about 20 inches wide. This narrow width is important to permit the roller 10 to be used to compact the bottom of trenches for laying pipeline and the like. The rear subframe 16 supports controls for the machine (not shown) as well as an enclosed storage compartment accessible via a pivotable cover 22. Referring to FIG. 2, the front subframe 18 supports an engine 24 accessible via a ventilated hood 26. The engine 24 supplies motive power to a pump 28that generates hydraulic pressure used to drive all hydraulically powered components of the roller 10. The roller 10 can be lifted for transport or deposited in a trench whose floor is to be compacted by connecting a chain or cable to a lift eye 30 located at the front of the rear subframe 16. The roller 10 is steered by a double acting hydraulic cylinder 32 extending between the rear and front subframes 16 and 18 along a line that is offset from the center of the pivot axis of the articulated subframes. Expansion and contraction of the hydraulic cylinder 32 causes the subframes 16 and 18 to pivot relative to one another, thereby steering the roller 10.

The rear and front drum assemblies 12 and 14 are mirror images of one another. The primary difference between the two drum assemblies is that the drive motor for the exciter assembly of the front drum assembly 14 is mounted in the associated axle housing from the right side of the machine 10, and the drive motor for the exciter assembly for the rear drum assembly 12 is inserted into the associated axle housing from the left side of the machine 10. The construction and operation of the front drum assembly 14 will now be described, it being understood that the description applies equally to the rear drum assembly 12.

Figure 4:
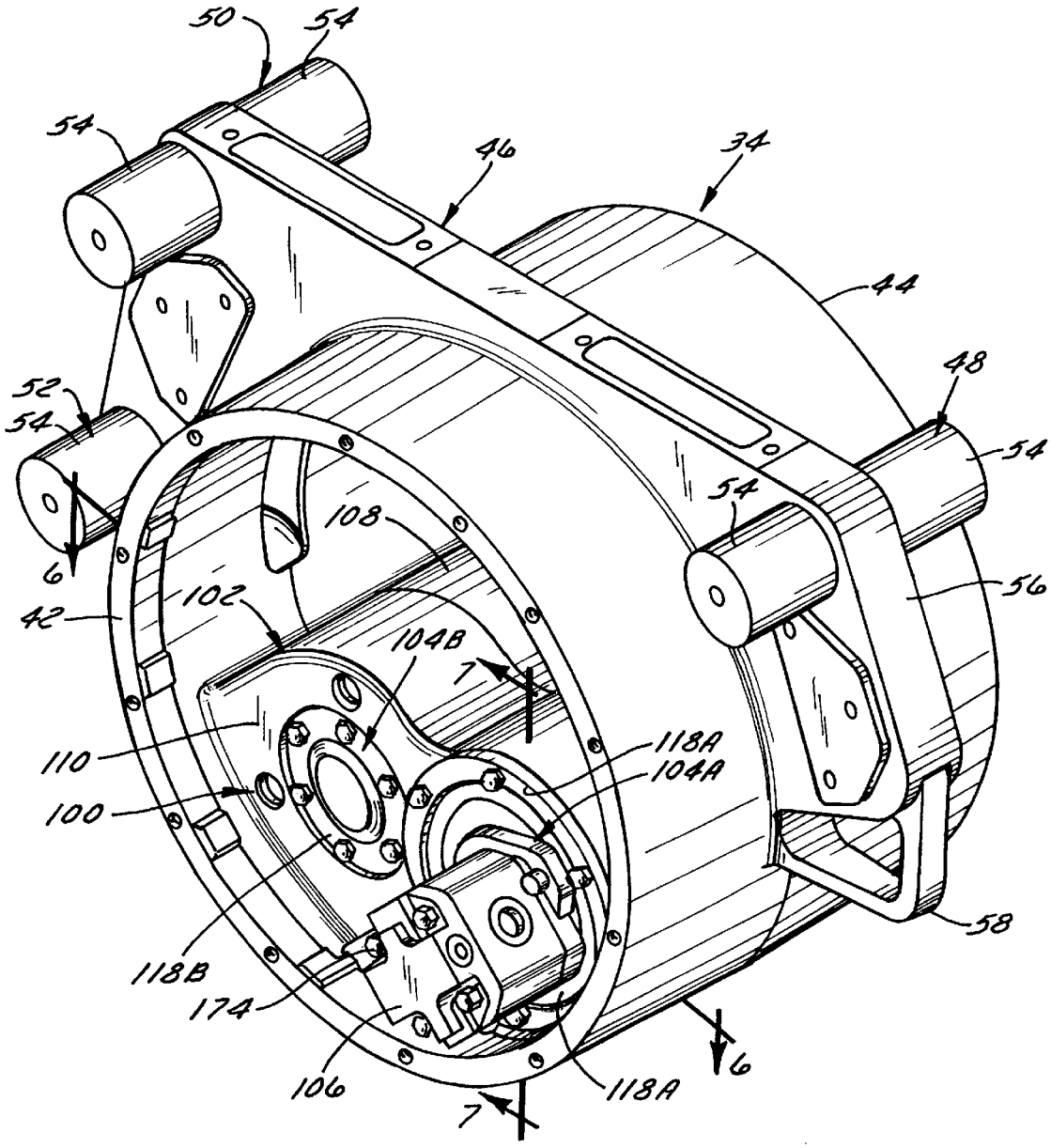
FIG. 4 is a perspective view of an axle housing of the trench roller of FIGS. 1–3.

Specifically, referring to FIGS. 3 and 4, the front drum assembly 14 includes an axle housing 34 that includes a pair of drum sections 36 and 38. The drum sections 36 and 38 surround opposite sides of the axle housing 34 and are mounted on the axle housing 34 by a common axle 40.

Figure 5:
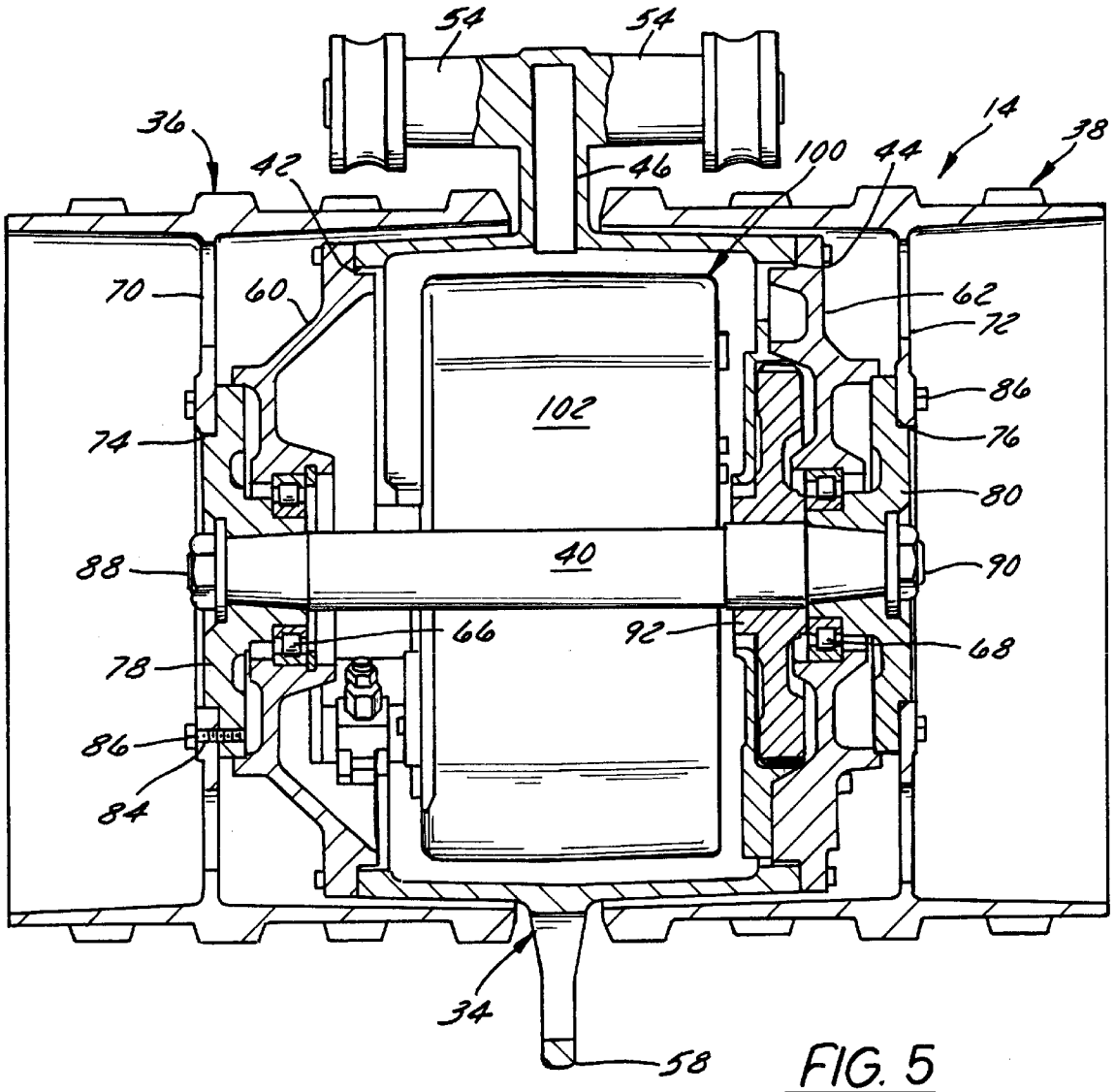
FIG. 5 is a sectional end elevation view taken generally along the lines 5—5 in FIG. 1.

As best seen in FIG. 4, the axle housing 34 is a cast metal housing that is generally tubular in shape and that has open ends 42 and 44. The axle housing 34 is bisected laterally by a mounting frame 46 that extends longitudinally of the machine 10 and that is connected to the front subframe 18 of the machine by mounts 48, 50, 52. Each mount includes two cylindrical pegs 54 that extend axially outwardly from opposite sides of the mounting frame 46 and that are connected to opposite sides of a U-shaped yoke on the subframe 18. A single mount 48 is located at the front of the axle housing 34 at the front of the machine 10 (see FIGS. 1 and 5) and is mounted on a first yoke 56. Two peripherally-spaced mounts 50 and 52 are provided at the rear of the axle housing 34 and are connected to associated yokes (not shown) located at the rear of the front subframe 18. In addition, a tie-down bracket 58 is provided at the front of the mounting frame 46 for receiving a tie down chain used to tie the roller 10 onto the bed of a truck during transport from site to site. Referring to FIG. 5, cover plates 60, 62 are bolted to and enclose the open axial ends 42 and 44 of the axle housing 34. Each cover plate 60, 62 has a center aperture for receiving the outer race of a respective bearing 66, 68 for the axle 40. One plate 60 is generally cup-shaped to make room for the exciter shaft drive motor 106, detailed below. The other plate 62 has a counterbore for receiving the axle drive gear 92, detailed below.

Referring now to FIGS. 1, 3, and 5, the drum sections 36 and 38 are mounted on opposite sides of the mounting frame 46 of the drum housing 34 so as to surround the axle housing 34. The outer surface of each drum portion 36 or 38 could be smooth, but is provided with a so-called sheep's foot surface in the illustrated embodiment so as to have compaction lugs or sheep's feet formed thereon. Each of the drum sections 36, 38 also extends laterally beyond the end of the axle housing 34 by an amount that determines the compaction width of the machine 10. In the illustrated embodiment in which the machine 10 is configured to compact a 32" wide strip, each of the drum sections 36, 38 extends beyond the associated cover plate 60, 62 by several inches. In an application in which the machine 10 is configured to compact a 22" wide strip, each drum section 36, 38 would be generally flush with the associated cover plate 60, 62. Each of the drum sections 36, 38 also has an internal flange 70, 72 having a central aperture 74, 76 for receiving an axle support hub 78, 80. Each flange 70, 72 is provided with a plurality of bores 84 to accommodate cap screws 86 that extend through the bores 84 and into mating tapped bores in the hub 78, 80. The axle 40 extends between the hubs 78, 80 and through the center of the axle housing 34. The ends of the axle 40 are connected to the hubs 78, 80 by nuts 88, 90. The axle 40, and hence the drum sections 36, 38, are supported on the cover plates 60 and 62 of the axle housing 34 via inner races of the bearings 66 and 68. The axle 40 is driven to rotate by a driven gear 92 that is mounted directly on the axle 40 and that is driven by a dedicated hydraulic motor (not shown) located in the axle housing 34.

3. Construction and Operation of Exciter Assembly

Each of the drum assemblies 12 and 14 is excited to vibrate by a separate exciter assembly 100. Both exciter assemblies 100 are identical, except for the fact that they are mirror images of one another so that their drive motors 106 (detailed below) are located at opposite sides of the machine 10. The following description of the front exciter assembly therefore is equally applicable to both exciter assemblies.

Referring now to FIGS. 4–7, the exciter assembly 100 for the front drum assembly 14 includes first and second exciter subassemblies 104A and 104B. The first exciter subassembly 104A is driven directly by a reversible hydraulic motor 106, and the second exciter subassembly 104B is slaved to the first exciter subassembly 104A. Both subassemblies 104A and 104B are designed to maximize ease of assembly and to minimize weight and size. Both subassemblies 104A and 104B are mounted in an exciter housing 102 located within the axle housing 34 of the front drum assembly 14.

Figure 6:
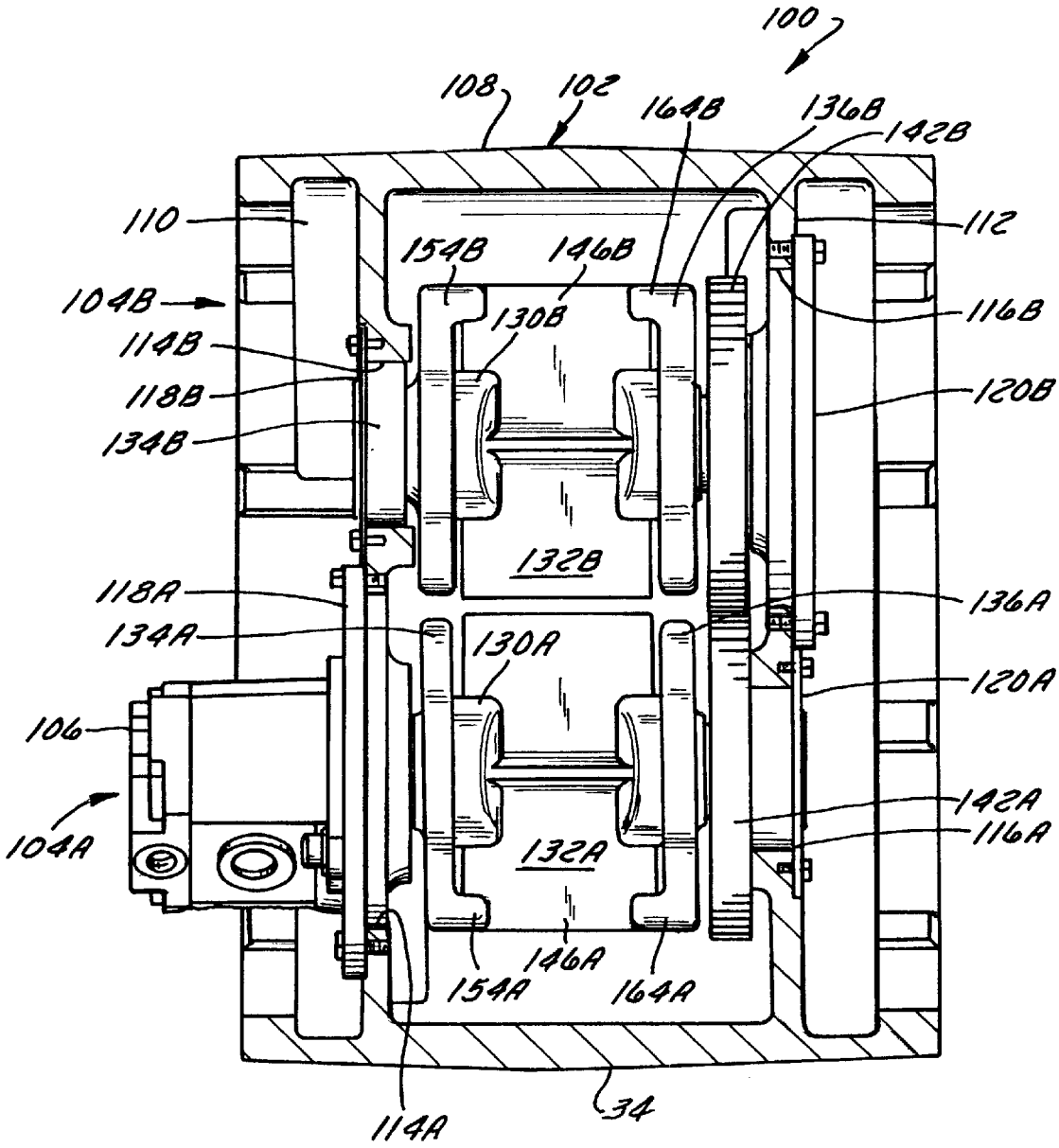
FIG. 6 is a sectional end elevation view taken generally along the lines 6—6 in FIG. 4.
Figure 7:
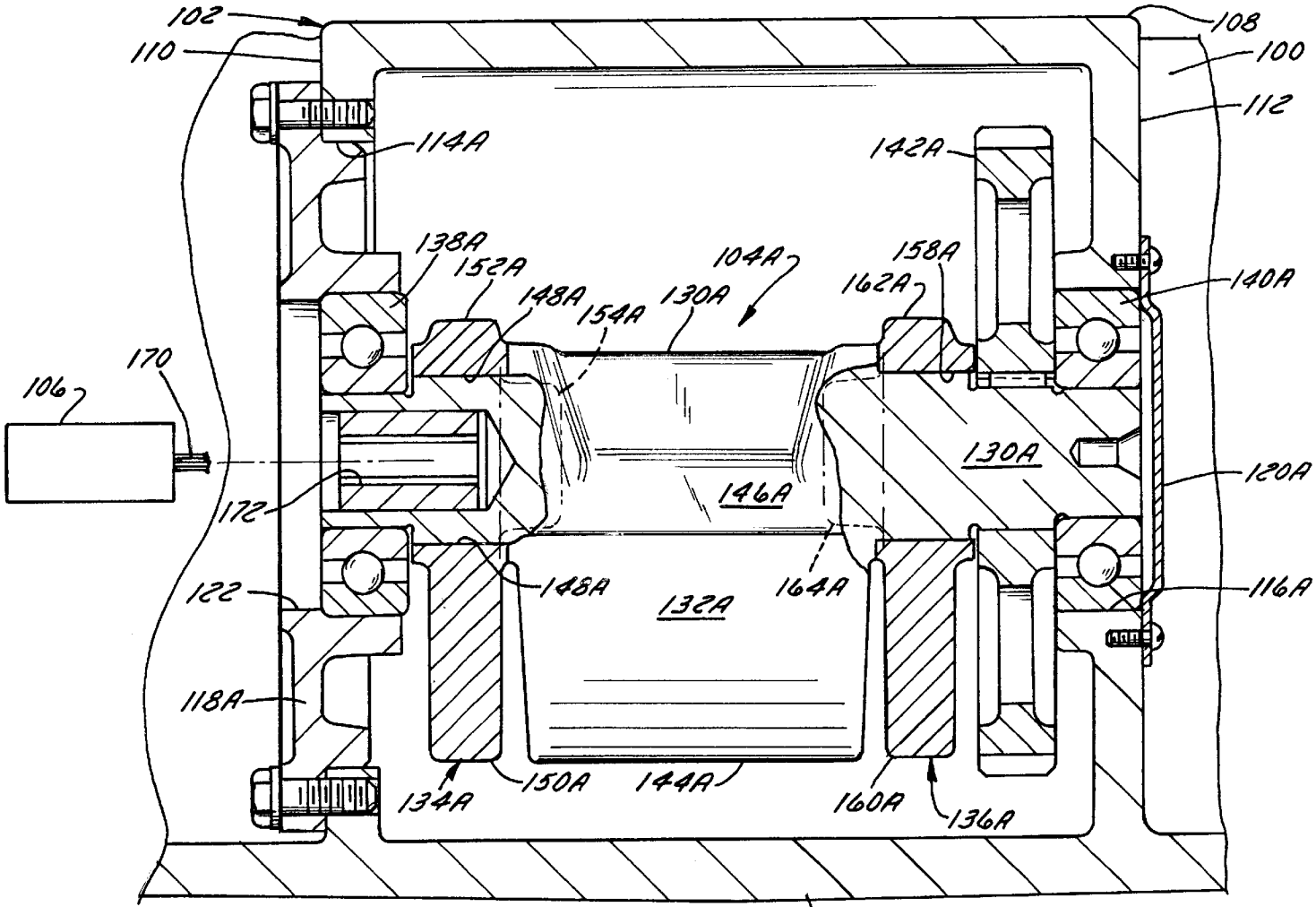
FIG. 7 is a sectional end elevation view taken generally along the lines 7—7 in FIG. 4.

Referring to FIGS. 4–7, the exciter housing 102 is formed integrally with the interior surface the axle housing 34 to facilitate assembly and to reduce the weight of the machine. It has an open interior encased by a radial peripheral wall 108 (a portion of which is formed integrally with the radial peripheral wall of the axle housing 34) and has opposed end walls 110 and 112, designated "left" and "right" endwalls herein because they are viewed from the front of the machine in the drawings and, accordingly, are located at the left and ride side portions of the drawings, respectively. Each end wall 110, 112 has a first bore 114A, 116A and a second bore 114B, 116B, formed therethrough for receiving a respective left and right end of the associated exciter subassembly 104A and 104B as detailed below. Each of the bores is capped by an end cap 118A, 118B, 120A, 120B bolted to the associated endwall 110, 112 of the exciter housing 102. As best seen in FIGS. 6 and 7, the right end cap 120A for the first exciter subassembly 104A and the left end cap 118B for the second exciter subassembly 104B comprise simple imperforate plates bolted to the associated endwalls 110, 112 of the exciter housing 102. The left end cap 118A for the first exciter subassembly 104A and the right end cap 120B for the second exciter subassembly 104B both are counterbored on their inner surface to form bearing supports. In addition, the left end cap 118A for the first exciter subassembly 104 has a central through bore 122 for passage of the hydraulic motor 106 as detailed below. This exciter housing configuration reduces the overall weight of the drum assembly 14, facilitates the assembly process, eliminates the potential for failure at the joint between the exciter housing 102 and the axle housing 34, and negates the need for an auxiliary access cover for exciter subassemblies 104A, 104B.

Figure 8:
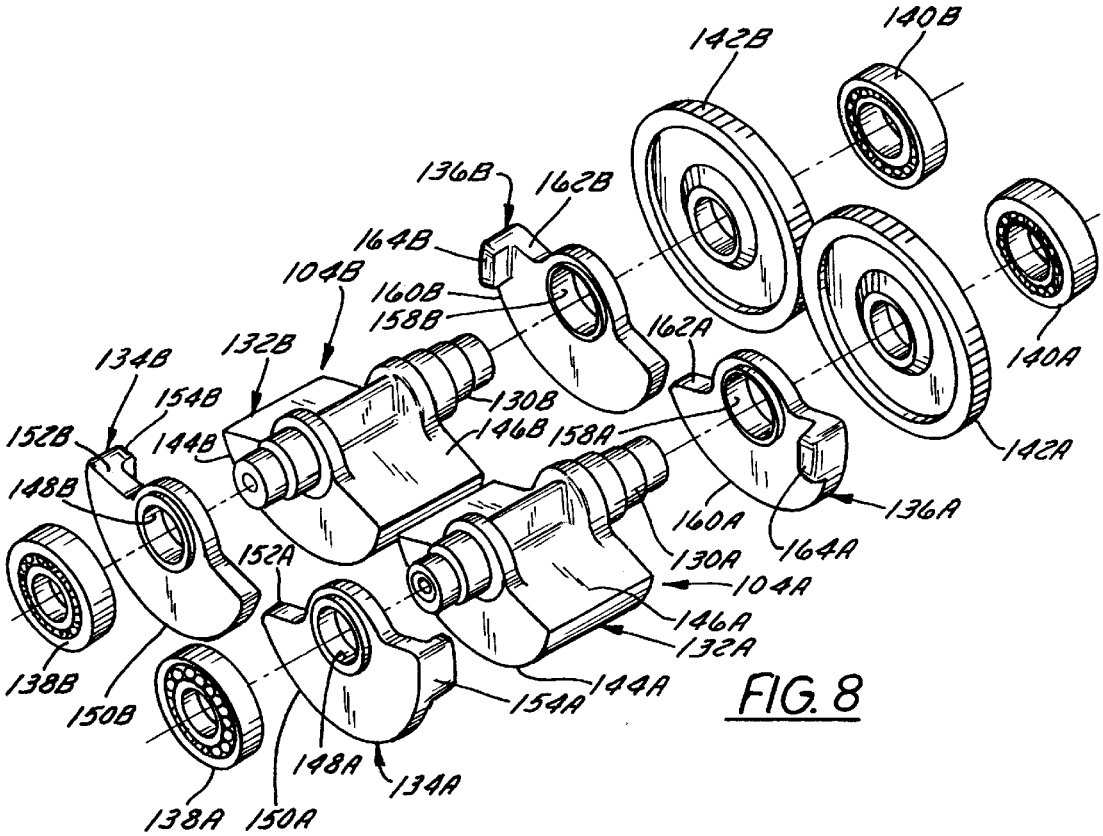
FIG. 8 is an exploded perspective view of an exciter assembly of the trench roller.
Figure 9:
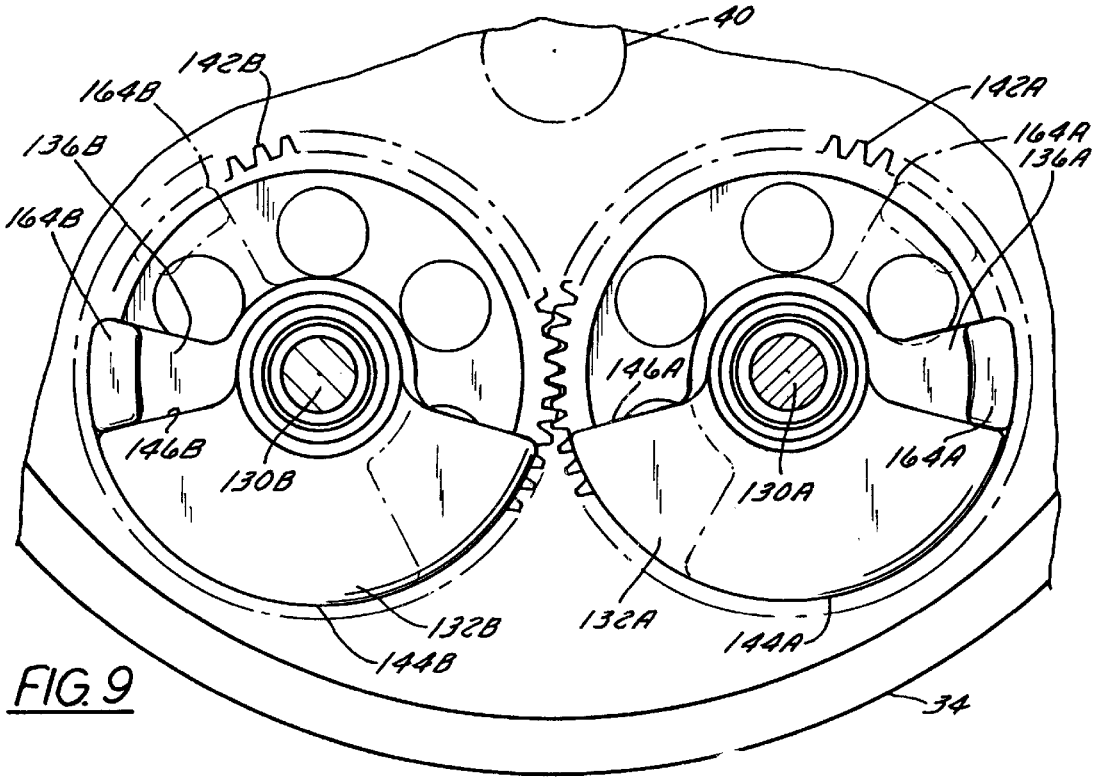
FIG. 9 is a fragmentary end elevation view of the exciter assembly of FIG. 8.

Referring especially to FIGS. 7–9, the first exciter subassembly 104A includes an exciter shaft 130A, a fixed eccentric weight 132A, and first and second free swinging weights 134A and 136A disposed adjacent opposite axial ends of the fixed weight 132A. The exciter shaft 130A is mounted in the exciter housing 102 by left and right bearings 138A and 140A that are pressed onto opposite ends of the exciter shaft 130A. The first free swinging weight 134A is sandwiched between the left bearing 138A and the left axial end of the fixed weight 132A. However, the first free swinging weight 134A is not otherwise coupled to any other element of the exciter subassembly 104A. Movement along the exciter shaft 130A is restrained solely by the fixed weight 132A and the bearing 138A. A drive gear 142A is pressed onto the right end of the exciter shaft 130A between the bearing 140A and the fixed eccentric weight 132A with the second free swinging weight 136A sandwiched between the drive gear 142A and the right end of the fixed weight 132A. As with the first eccentric weight 134A, the second eccentric weight 136A is restrained from axial movement along the exciter shaft 130A solely by the fixed eccentric weight 132A and the drive gear 142A.

All three weights 132A, 134A, and 136A of exciter subassembly 104A are designed to maximize eccentricity while minimizing the overall inertia of the exciter assembly 100. Referring to FIGS. 7 and 8, the fixed weight 132A is relatively massive, having an axial length that exceeds the combined axial length of both free swinging weights 134A and 136A. It is generally semi-cylindrical in shape to maximize its eccentricity and, therefore, has (1) an arcuate outer radial peripheral surface 144A and (2) a relative flat inner radial edge surface 146A formed from two portions extending generally radially from opposite sides of the exciter shaft 130A. Preferably, in order to facilitate assembly and reduce inertia, the fixed weight 132A is cast integrally with the exciter shaft 130A as best seen in FIG. 8.

Still referring to FIGS. 7 and 8, the first free weight 134A comprises a cast metal member having a through-bore 148A for mounting on the associated portion of the exciter shaft 130A. As with the fixed eccentric weight 132A, the first free swinging weight 134A is highly eccentric, having (1) an arcuate outer surface 150A and (2) a relatively flat inner surface 152A formed by first and second portions extending generally radially from opposite sides of the exciter shaft 130A. A tab 154A extends axially inwardly from an axial surface of the free swinging weight 134A so as to protrude over the adjacent outer axial edge of the fixed weight 130A as best seen in FIG. 6. When the exciter shaft 130A is driven to rotate in a first direction, the free swinging weight 134A swings to an angular position in which one side of the tab 154A engages a first side of the fixed weight 132A as illustrated in solid lines in FIG. 9 and in which the eccentricity of the free swinging weight 134A adds to the eccentricity of the fixed weight 132A, thereby increasing the vibrational amplitude of the exciter subassembly 104A. Conversely, when the exciter shaft 130A is driven to rotate in the opposite direction, the free swinging weight 134A swings to an angular position in which the opposite side of the tab 154A engages the opposite side of the fixed weight 132A as illustrated in phantom lines in FIG. 9 and in which the eccentricity of the free swinging weight 134A detracts from the eccentricity of the fixed weight 132A, thereby reducing the vibrations generated by the exciter subassembly 104A.

The second free swinging weight 136A is a mirror image of the first free swinging weight 134A and, accordingly, need not be described in detail. Suffice it to say that it has a bore 158A, an outer arcuate radial peripheral surface 160A, a relatively flat inner radial peripheral surface 162A, and a tab 164A that extends axially over the right end of the fixed weight 132A.

The first exciter subassembly 104A is driven by the coaxial reversible hydraulic motor 106. The motor 106 is fastened to end plate 118A by bolts 174 at a location axially between the left end wall 110 of the exciter housing 102 and the left cover plate 60. An output shaft 170 of the motor 106 extends through the bore 122 in the left end plate 118A and is affixed directly to the axial end of the exciter shaft 130A via a splined drive coupling 172 the motor 106. Mounting the motor 106 coaxially with the exciter shaft 130 within an axle housing 34 of standard length is not possible with standard exciter assembly designs but is possible with the invention due to the lack of the need for bulky mounting hardware for the free swinging weights 134A, 136A, and some of the other components. This coaxially mounting considerably facilitates system assembly and also renders hydraulic hoses and fittings more accessible for maintenance or repair.

The second exciter subassembly 104B is essentially identical to the first exciter subassembly 104A except for the fact that it is driven indirectly by the first exciter subassembly 104A as opposed to being driven directly by a motor. It therefore includes an exciter shaft 130B, a fixed eccentric weight 132B, first and second free swinging weights 134B, 136B, a driven gear 142B, and left and left bearings 138B and 140B. Torque is transferred to the driven gear 142B directly by the drive gear 142A on the first exciter subassembly 104A as best seen in FIG. 9.

Referring to FIG. 7, the exciter subassembly 104A is preassembled by press-fitting or otherwise affixing the left bearing 138A and the drive gear 142A onto the exciter shaft 130A with the first and second free swinging weights 134A, 136A sandwiched between these components and the respective ends of the fixed weight 132A. The right bearing 140A is then press fit or otherwise affixed to the right end of the exciter shaft 130A. Then, the outer race of the left bearing 138A is press-fit into the counterbore in the associated end plate 118A, and the exciter subassembly 104A is then inserted into the bores 114A and 116A from the left to a position in which the right bearing 140A of the first exciter subassembly 104A is supported in the periphery of the associated bore 116A in the exciter housing end wall 112. The end plates 118A and 120A are then bolted to the associated housing end walls 110, 112. The same procedure is used to assemble the second subassembly 104B and to install it in the exciter housing 102, except for the fact that the exciter subassembly 104B is inserted from the right side of the housing 102 rather than the left. The motor 106 is then inserted through the bore 122 in the left end plate 118A and attached directly to the drive coupling 172 on the end of the exciter shaft 130A. Finally the cover plates 60 and 62 are bolted to the ends of the axle housing 34 as detailed above to complete the drum assembly.

During operation of a trench roller 10, the roller 10 is positioned at the bottom of a trench or on another surface to be compacted, and the engine 24 and pump 28 are operated to supply drive torque to the axles 40 of the drum assemblies 12, 14 via the drive gears 92, thereby propelling the trench roller 10 along the surface to be compacted. The exciter assembly drive motors 106 are simultaneously operated to supply drive torque to the exciter assemblies 100, thereby generating vibrations of a magnitude that very depending upon the direction of motor output shaft rotation. The exciter assemblies 100 are driven up to speed very quickly during start up under relatively low drive torques due to the low inertia of the relatively lightweight exciter assemblies 100.

Many changes and modifications could be made to the invention without departing from the spirit thereof. For instance, the inventive exciter assembly is usable with a variety of ground compactors other than a multi-drum trench roller. The invention is also applicable to exciter assemblies having only a single exciter subassembly as opposed to two exciter subassemblies. The free swinging weights also could be restrained from axial movement along the associated exciter shafts by components other than bearings and gears, so long as no external mounting hardware is utilized. Possible components include a press-fit collar, a hub, or a snap ring. The scope of other changes will become apparent from the appended claims.

We claim:

1. An exciter assembly for a vibratory roller, comprising:

(A) an exciter housing;

(B) an exciter shaft rotatably journaled in said exciter housing;

(C) a fixed eccentric weight rotationally fixed to said exciter shaft;

(D) a free swinging eccentric weight mounted on said exciter shaft so as to rotate with respect to said exciter shaft between 1) a first angular position in which the eccentricity of said free swinging eccentric weight adds to the eccentricity of said fixed eccentric weight and 2) a second angular position in which the eccentricity of said free swinging eccentric weight detracts from the eccentricity of said fixed eccentric weight, wherein said free swinging eccentric weight is mounted on said exciter shaft so as to be restrained from substantial axial movement along said exciter shaft without the use of any retaining structure that is fixed to said free swinging eccentric weight, wherein said free swinging eccentric weight is sandwiched between a first end of said fixed eccentric weight and a component comprising one of a torque transfer element and a bearing and is restrained from substantial axial movement along said exciter shaft solely by said first end of said fixed eccentric weight and said component.

2. The exciter assembly as recited in claim 1, wherein said free swinging eccentric weight is a first free swinging eccentric weight, and further comprising a second free swinging eccentric weight mounted on said exciter shaft so as to rotate with respect to said exciter shaft between 1)a first angular in which the eccentricity of said second free swinging eccentric weight adds to the eccentricity of said fixed weight and 2) a second angular position in which the eccentricity of said second free swinging eccentric weight detracts from the eccentricity of said fixed eccentric weight, wherein said second free swinging eccentric weight is located axially between a second end of said fixed eccentric weight and another component comprising the other of said torque transfer element and said bearing and is restrained from substantial axial movement along said exciter shaft by said second end of said fixed eccentric weight and said another component, respectively.

3. An exciter assembly for a vibratory roller, comprising:

(A) an exciter housing;

(B) an exciter shaft rotatably journaled in said exciter housing;

(C) a fixed eccentric weight rotationally fixed to said exciter shaft;

(D) a rigid free swinging eccentric weight mounted on said exciter shaft so as to rotate as a unit with respect to said exciter shaft between 1) a first angular position in which the eccentricity of said rigid free swinging eccentric weight adds to the eccentricity of said fixed eccentric weight and 2) a second angular position in which the eccentricity of said rigid free swinging eccentric weight detracts from the eccentricity of said fixed eccentric weight, wherein said rigid free swinging eccentric weight is mounted on said exciter shaft so as to be restrained from substantial axial movement along said exciter shaft without the use of any retaining structure that is fixed to said rigid free swinging eccentric weight, wherein said free swinging eccentric weight is sandwiched between a first end of said fixed eccentric weight and a component comprising one of a torque transfer element and a bearing that is axially spaced from said fixed eccentric weight, and wherein said free swinging eccentric weight has a tab that extends over an adjacent axial end of said fixed eccentric weight and that engages a first side of said fixed eccentric weight when said free swinging eccentric weight is in said first angular position and that engages a second side of said fixed eccentric weight when said free swinging eccentric weight is in said second angular position.

4. An exciter assembly for a vibratory roller, comprising:

(A) an exciter housing;

(B) a first exciter shaft rotatably journaled in said exciter housing;

(C) a first fixed eccentric weight rotationally fixed to said exciter shaft;

(D) a first free swinging eccentric weight mounted on said exciter shaft so as to rotate with respect to said exciter shaft between 1) a first angular position in which the eccentricity of said first free swinging eccentric weight adds to the eccentricity of said first fixed eccentric weight and 2) a second angular position in which the eccentricity of said first free swinging eccentric weight detracts from the eccentricity of said first fixed eccentric weight, wherein said first free swinging eccentric weight is mounted on said first exciter shaft so as to be restrained from substantial axial movement along said first exciter shaft without the use of any retaining structure that is fixed to said first free swinging eccentric weight, (E) a second exciter shaft rotatably journaled in said exciter housing;

(F) a second fixed eccentric weight rotationally fixed to said second exciter shaft; and (G) a second free swinging eccentric weight mounted on said second exciter shaft so as to rotate with respect to said second exciter shaft between 1) a first angular position in which the eccentricity of said second free swinging eccentric weight adds to the eccentricity of said second fixed eccentric weight and 2) a second angular position in which the eccentricity of said second free swinging eccentric weight detracts from the eccentricity of said second fixed eccentric weight, wherein said second free swinging eccentric weight is mounted on said second exciter shaft so as to be restrained from substantial axial movement along said second exciter shaft without the use of any retaining structure that is fixed to said second free swinging eccentric weight, further comprising a drive element which is mounted on said first exciter shaft such that said free swinging eccentric weight on said first exciter shaft is restrained from substantial axial movement along said first exciter shaft solely by said first fixed eccentric weight and by said drive element, and a driven element which is mounted on said second exciter shaft such that said free swinging eccentric weight on said second exciter shaft is restrained from substantial axial movement along said second exciter shaft solely by said second fixed eccentric weight and by said driven element, and wherein said drive element is coupled to said driven element so as to transfer drive torque thereto.

5. The exciter assembly as recited in claim 4, wherein said free swinging eccentric weight is a first free swinging eccentric weight, and wherein said fixed eccentric weight is a first fixed eccentric weight, and further comprising a first bearing which supports said first exciter shaft on said exciter housing;

wherein said first free swinging eccentric weight is mounted on said first exciter shaft between said first fixed eccentric weight and said first bearing and which is restrained from substantial axial movement along said first exciter shaft solely by said first fixed eccentric weight and said first bearing, respectively;

a second bearing which supports said second exciter shaft on said exciter housing; and a second free swinging eccentric weight mounted on said second exciter shaft between said second fixed eccentric weight and said second bearing and which is restrained from substantial axial movement along said second exciter shaft solely by said second fixed eccentric weight and said second bearing, respectively.

6. An exciter assembly that is configured to impart vibrations to a rotating drum assembly of a vibratory roller, comprising:

(A) an exciter housing which is formed integrally with an axle housing of the rotating drum assembly;

(B) an exciter shaft which is rotatably journaled in said exciter housing by at least first and second bearings;

(C) a fixed eccentric weight which is rotationally fixed to said exciter shaft;

(D) a first free swinging eccentric weight which is sandwiched between a first end of said fixed eccentric weight and said first bearing and which is restrained from substantial axial movement along said exciter shaft solely by said fixed eccentric weight and said first bearing;

(E) a second free swinging eccentric weight 1) which is sandwiched between a second end of said fixed eccentric weight and a component consisting of a) said second bearing and b) a torque transfer element fixed to said exciter shaft and 2) which is restrained from substantial axial movement along said exciter shaft solely by said fixed eccentric weight and said component.

7. The exciter assembly as recited in claim 6, wherein said exciter shaft is a first exciter shaft, said fixed eccentric weight is a first fixed eccentric weight, and said second free eccentric weight is sandwiched between said first fixed eccentric weight and first torque transfer element which is fixedly mounted on said first exciter shaft, and further comprising a second exciter shaft which is rotatably journaled in said exciter housing by at least third and fourth bearings;

a second torque transfer element which is fixedly mounted on said second exciter shaft and operatively coupled to said first torque transfer element;

a second fixed eccentric weight which is rotationally fixed to said second exciter shaft;

a third free swinging eccentric weight which is sandwiched between a first end of said second fixed eccentric weight and said third bearing and which is restrained from substantial axial movement along said second exciter shaft solely by said second fixed eccentric weight and said third bearing; and a fourth free swinging eccentric weight which is sandwiched between a second end of said second fixed eccentric weight and said second torque transfer element and which is restrained from substantial axial movement along said second exciter shaft solely by said second fixed eccentric weight and said second torque transfer element.

8. A vibratory roller comprising:

(A) a chassis;

(B) a drum assembly supporting said chassis on a surface to be compacted, said drum assembly being hollow and having a length corresponding to a width of a strip to be compacted, said drum assembly comprising an axle housing and a drum rotatably supported on said axle housing via an axle; and (C) an exciter assembly which imparts vibrations to said drum and which is fully contained within said drum, said exciter assembly comprising:

(1) an exciter housing located within said axle housing, (2) an exciter shaft rotatably journaled in said exciter housing by first and second bearings, (3) a fixed eccentric weight rotationally fixed to said exciter shaft, (4) first and second free swinging eccentric weights, each of which is mounted on said exciter shaft so as to rotate with respect to said exciter shaft between 1) a first angular position in which the eccentricity of said first and second free swinging eccentric weights adds to the eccentricity of said fixed eccentric weight and 2) a second angular position in which the eccentricity of said first and second free swinging eccentric weights detracts from the eccentricity of said fixed eccentric weight, and (5) a motor having a rotary output shaft which is coupled to said exciter shaft and which is co-axial with said exciter shaft.

9. The vibratory roller as recited in claim 8, wherein each of said first and second free swinging eccentric weights is mounted on said exciter shaft between a respective end of said fixed eccentric weight and an adjacent component of said exciter assembly so as to be restrained from substantial axial movement along said exciter shaft without the use of any retaining structure that is fixed to said first and second free swinging eccentric weights.

10. The vibratory roller as recited in claim 9, wherein said first free swinging eccentric weight is sandwiched between said fixed eccentric weight and one of said first and second bearings and said second free swinging eccentric weight is sandwiched between said fixed eccentric weight and a torque transfer element affixed to said exciter shaft.

11. The vibratory roller as recited in claim 8, wherein said vibratory roller is a vibratory trench roller, and wherein said rotary output shaft is splined directly to said exciter shaft.

12. The vibratory roller as recited in claim 8, wherein said fixed eccentric weight is formed integrally with said exciter shaft.

13. The vibratory roller as recited in claim 8, wherein said exciter housing is formed integrally with said axle housing.

14. A method of assembling an exciter assembly for a compaction machine comprising:

(A) fixing a torque transfer element and a bearing to an exciter shaft;

(B) fixing an eccentric weight to said exciter shaft;

(C) mounting first and second free swinging eccentric weights on said exciter shaft adjacent respective ends of said fixed eccentric weight so as to be rotatable a limited amount relative to said exciter shaft;

(D) restraining said first and second free swinging eccentric weights from substantial axial movement along said exciter shaft solely by sandwiching said first and second free swinging eccentric weights between said respective ends of said fixed eccentric weight and operative components of said exciter assembly, each of said operative components comprising one of said bearing and said torque transfer element.

15. The method as recited in claim 14, wherein the step of axially restraining said first and second free swinging eccentric weights comprises sandwiching said first free swinging eccentric weight between said fixed eccentric weight and said bearing and sandwiching said second free swinging eccentric weight between said fixed eccentric weight and said torque transfer element.

16. The method as recited in claim 15, wherein said exciter shaft is a first exciter shaft, said fixed eccentric weight is a first fixed eccentric weight, said bearing is a first bearing, and said torque transfer element is a first torque transfer element, and further comprising:

fixing a second torque transfer element and a second bearing to a second exciter shaft;

fixing a second eccentric weight to said second exciter shaft;

mounting third and fourth free swinging eccentric weights on said second exciter shaft adjacent respective ends of said second fixed eccentric weight so as to be rotatable a limited amount relative to said second exciter shaft;

restraining said third free swinging eccentric weight from substantial axial movement along said second exciter shaft solely by sandwiching said third free swinging eccentric weight between said second fixed eccentric weight and said second bearing; and restraining said fourth free swinging eccentric weight from substantial axial movement along said second exciter shaft solely by sandwiching said fourth free swinging eccentric weight between said second fixed eccentric weight and said second torque transfer element.

17. The method as recited in claim 14, further comprising coupling an output shaft of a motor to said exciter shaft such that said motor output shaft extends coaxially with said exciter shaft.

18. The method as recited in claim 14, wherein at least some of the fixing steps comprise pressing the associated components onto said exciter shaft.

19. The method as recited in claim 14, wherein the step of fixing said fixed eccentric weight to said exciter shaft comprises forming said fixed eccentric weight integrally with said exciter shaft.

20. A method comprising:

(A) assembling an exciter assembly by (1) fixing a torque transfer element and a bearing to an exciter shaft, (2) fixing an eccentric weight to said exciter shaft, (3) mounting first and second free swinging eccentric weights on said exciter shaft adjacent respective ends of said fixed eccentric weight so as to be rotatable a limited amount relative to said exciter shaft, and (4) restraining said first and second free swinging eccentric weights from substantial axial movement along said exciter shaft solely by sandwiching said first and second free swinging eccentric weights between said respective ends of said fixed eccentric weight and operative components of said exciter assembly, each of said operative components comprising one of said bearing and said torque transfer element; then (B) inserting said exciter assembly axially into an opening in an exciter housing and mounting said exciter assembly in said exciter housing;

(C) mounting said exciter assembly on a trench roller in operative communication with a rotatable drum assembly that supports said trench roller on a surface to be compacted.

21. The method as recited in claim 20, wherein the step of axially restraining said first and second free swinging eccentric weights comprises sandwiching said first free swinging eccentric weight between said fixed eccentric weight and said bearing and sandwiching said second free swinging eccentric weight between said fixed eccentric weight and said torque transfer element, and wherein said exciter shaft is a first exciter shaft, said fixed eccentric weight is a first fixed eccentric weight, said bearing in a first bearing, said opening in said exciter housing is a first opening, and said torque transfer element is a first torque transfer element, and further comprising assembling a second exciter assembly by:

fixing a second torque transfer element and a second bearing to a second exciter shaft, fixing a second eccentric weight to said second exciter shaft, mounting third and fourth free swinging eccentric weights on said second exciter shaft adjacent respective ends of said second fixed eccentric weight so as to be rotatable a limited amount relative to said second exciter shaft, restraining said third free swinging eccentric weight from substantial axial movement along said second exciter shaft solely by sandwiching said third free swinging eccentric weight between said second fixed eccentric weight and said second bearing, restraining said fourth free swinging eccentric weight from substantial axial movement along said second exciter shaft solely by sandwiching said fourth free swinging eccentric weight between said second fixed eccentric weight and said second torque transfer element, and inserting said second exciter assembly axially into a second opening in said exciter housing and mounting said second exciter assembly in said exciter housing.

22. The method as recited in claim 20, further comprising coupling an output shaft of a motor to said exciter shaft such that said motor output shaft extends coaxially with said exciter shaft.

23. The method as recited in claim 20, wherein the inserting step comprises inserting the exciter assembly into an exciter housing that is formed integrally with an axle housing of said trench roller.

* * * * *